United States Patent [19]

Taniguchi

[11] Patent Number: 4,976,595

[45] Date of Patent: Dec. 11, 1990

[54] TROCHOID PUMP WITH RADIAL CLEARANCES BETWEEN THE INNER AND OUTER ROTORS AND BETWEEN THE OUTER ROTOR AND THE HOUSING

[75] Inventor: Katuhico Taniguchi, Hamamatsu, Japan

[73] Assignee: Suzuki Jidosha Kogyo Kabushiki Kaisha, Shizuoka, Japan

[21] Appl. No.: 327,291

[22] Filed: Mar. 22, 1989

[30] Foreign Application Priority Data

Mar. 31, 1988 [JP] Japan ..... 63-79150

[51] Int. Cl.[5] ..... F04C 2/10

[52] U.S. Cl. ..... 418/171

[58] Field of Search ..... 418/166, 171, 107, 108, 418/109

[56] References Cited

U.S. PATENT DOCUMENTS

| | | | |
|---|---|---|---|
| 3,551,079 | 12/1970 | Brundage | 418/171 |
| 3,907,465 | 9/1975 | Dorff | 418/171 |
| 4,504,202 | 3/1985 | Saegusa | 418/171 |

FOREIGN PATENT DOCUMENTS

| | | | |
|---|---|---|---|
| 20406 | 5/1929 | Australia | 418/166 |
| 47-33843 | 8/1972 | Japan . | |
| 753044 | 3/1954 | United Kingdom | 418/171 |

*Primary Examiner*—John J. Vrablik
*Assistant Examiner*—David L. Cavanaugh
*Attorney, Agent, or Firm*—Flynn, Thiel, Boutell & Tanis

[57] ABSTRACT

A trochoidal pump having an inner rotor and an outer rotor incorporated eccentrically to each other within a housing bore of a pump housing. The inner and outer rotors have internal and external teeth defined by a trochoid and held in intermeshing engagement. The center of the outer rotor is set to ensure that the distance defined between the tip ends of the internal and external teeth will be greater than zero when the tip end of the internal tooth of the inner rotor and the tip end of the external tooth of the outer rotor are positioned directly opposite each other by the rotation of the outer rotor in assocation with the inner rotor.

7 Claims, 4 Drawing Sheets

TROCHOID PUMP WITH RADIAL CLEARANCES BETWEEN THE INNER AND OUTER ROTORS AND BETWEEN THE OUTER ROTOR AND THE HOUSING

FIELD OF THE INVENTION

The present invention relates to a trochoidal pump, and particularly to a trochoidal pump used as an oil pump for an internal combustion engine of a vehicle or an automatic transmission.

BACKGROUND OF THE INVENTION

Among known oil pumps are a gear pump for feeding oil under pressure by two gears which are in intermeshing engagement, a trochoidal pump having an inner rotor and an outer rotor, etc.

The trochoidal pump comprises an inner rotor having internal teeth and an outer rotor having external teeth, the rotors being defined by a trochoid and incorporated within a housing section of a pump housing eccentrically to each other, the teeth of the inner rotor being one fewer in number than those of the outer rotor, and the outer rotor being adapted to rotate in the same direction of the inner rotor in association with the latter to provide variable volume spaces defined between the internal teeth and the external teeth so that fluid flows in and out through inlet and outlet ports. This trochoidal pump is, as compared with other kinds of oil pumps of same capacity, small in size, simple in construction, and less noisy while the teeth intermesh, and so has a wide application as a lubricating oil pump for vehicles or as an oil pump for automatic speed change gears.

The above construction of the trochoidal pump is, for example, disclosed by Japanese Patent Publication No. 47-33843. The disclosed device is a differential consisting of an oil pump constituted by a trochoidal pump and a motor, which device is compact in configuration, with the interval between the output shafts optionally expandable, and has a hydraulic circuit which is made narrow in its intermediate portion to provide an easy differential restriction, and additionally, this hydraulic circuit can be removed outside the differential gear to be attached to a control valve, thereby facilitating interruption of driving in the exchange of a differential gear, differential locking device.

As shown in FIGS. 7 and 8, with a trochoidal pump 12, the distance between the center i of the inner rotor 18 and the center o of the outer rotor 20 is E (amount of space between centers), and the respective coordinates are dependent upon the center i of the inner rotor 18 and the center P of a housing bore (pocket) of a pump-housing section which accommodates the outer rotor 20. In order to allow the rotation of the inner and outer rotors, there is required a determined distance or space T between the tip end **18*b*, of the tooth 18*a* of the inner rotor 18 and the tip end 20*b* of the tooth 20*a* of the outer rotor 20, and a determined distance B between the outer periphery 20*c* of the outer rotor 20 and the inner periphery 24*c* of the housing section 24 when the tip ends 18*b* and 20*b*** are positioned directly opposed to each other.

The clearances formed when the inner rotor 18 is pressed against the outer rotor 20 in a vertical direction with the tip end **18*b* of the internal tooth 18*a* positioned opposite to the tip end 20*b* of the external tooth 20*a* are maximum (Tmax) and minimum (Tmin, which in this case is equal to zero) as the distance T. Additionally, if the difference between the inner diameter DP of the housing section 24 and the outer diameter DO of the outer rotor 20 is C, the distance E between centers is defined as a distance between the centers of the inner and outer rotors 18, 20 upon settings of the distance $T=(Tmax+Tmin)\times 0.5$ and of the distance $B/2=0.5\times C$ (see FIG. 8**).

Since the center i of the inner rotor 18 is stationary, the outer rotor 20 is displaced as its distance E between centers varies within the range restricted to the said distances, so as to become stable or vibrate at a certain position when the drive torque, discharge pressure, and entrapment pressure (or tolerances of the respective portions) are in a state of equilibrium.

In this state, however, interference occurs between the internal tooth **18*a* of the inner rotor 18 and the external tooth 20*a* of the outer rotor 20 (trochoid interference), causing irregular intermeshing between the internal tooth 18*a* of the inner rotor 18 and the external tooth 20*a* of the outer rotor 20, thus resulting in occurrence of pump noise (namely roaring). That is, as $Tmin=0$, if $0.5\times B>0.5\times Tmax$, by the movement of the center O of the outer rotor 20 (variation of the distance E between centers) the distance T (Tmax) is reduced to zero in FIGS. 7 and 8, thereby causing an occurrence of trochoid interference between the internal tooth 18*a* and the external tooth 20*a*** with the consequential irregular intermeshing engagement causing inconvenience of production or pump noise.

The object of the present invention is to obviate the above inconvenience, and to provide a trochoidal pump wherein the center of the outer rotor is set to ensure that the distance between the opposed tip ends of the internal and external teeth is made larger than zero, so that occurrence of pump noise by the fluctuation of the outer rotor may be effectively reduced.

It is also an object of the present invention to prevent an occurrence of irregular intermeshing engagement between the tip end of the internal tooth of the inner rotor and the tip end of the external tooth of the outer rotor even when the outer rotor is vibrated during its rotation in accordance with the rotation of the inner rotor, thereby to effectively diminish the generation of pump noise as irregular intermeshing noise.

In order to attain this object, the present invention provides a trochoidal pump comprising an inner rotor and an outer rotor incorporated eccentrically to each other within a housing section of a pump housing, the inner and outer rotors having internal and external teeth defined by a trochoid and held in intermeshing engagement, characterized in that the center of the outer rotor is set to ensure that the distance defined between the tip ends of said internal and external teeth will be greater than zero when the tip end of the internal tooth of the inner rotor and the tip end of the external tooth of the outer rotor are positioned opposite to each other by the rotation of the outer rotor in association with the inner rotor.

In accordance with the construction of the present invention, since the center of the outer rotor is set to ensure that the distance between the tip ends will be greater than zero, independent from the fluctuation of the outer rotor, any interference can be avoided between the internal tooth of the inner rotor and the external tooth of the outer rotor, and regular intermeshing of the internal tooth and the external tooth may be achieved, thus resulting in a decrease in the pump noise.

BRIEF DESCRIPTION OF THE DRAWINGS

FIGS. 1–3 show a first embodiment of the present invention wherein:

FIG. 1 is a perspective view of an internal combustion engine,

FIG. 2 is an exploded perspective view of a trochoidal pump, and

FIG. 3 is a schematic view indicating the respective positional relation between the inner rotor, outer rotor and housing section.

DETAILED DESCRIPTION

Figure 1:
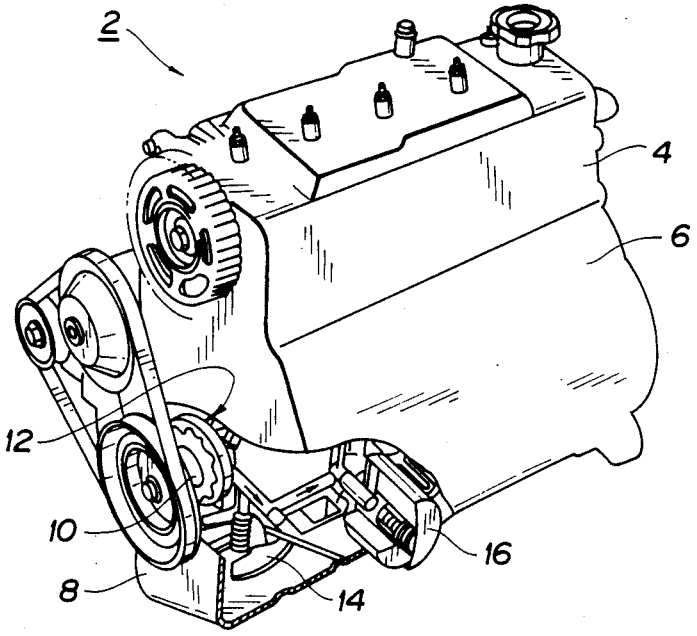
Figure 2:
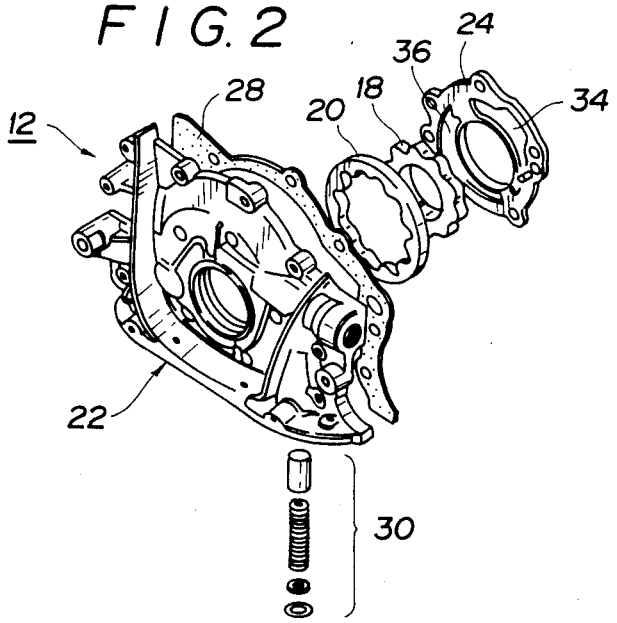
Figure 3:
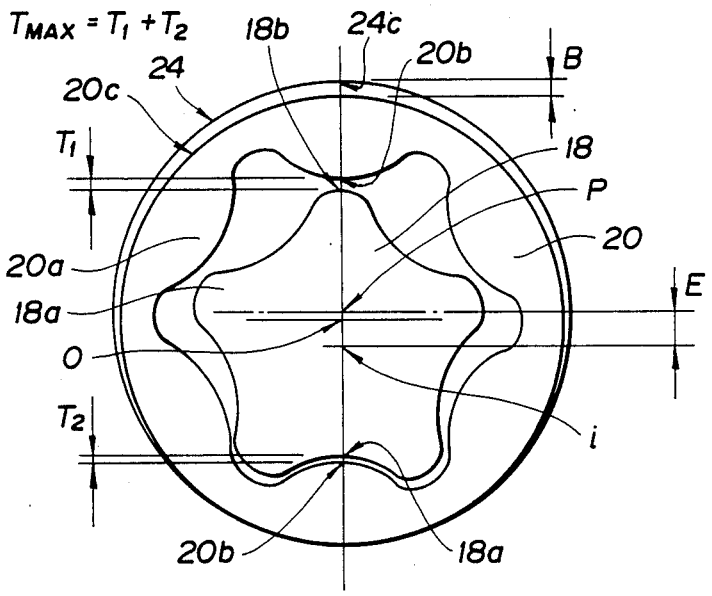

FIGS. 1–3 show a first embodiment of this invention. In the drawings, the numeral 2 designates an internal combustion engine, 4 a cylinder head, 6 a cylinder block, and 8 an oil pan. On a crank shaft 10 attached to the cylinder block 6, for example, is mounted a trochoidal pump 12 serving as an oil pump for feeding lubricating oil and the like under pressure inside the internal combustion engine 2. This trochoidal pump 12 is intended to supply lubricating oil to various parts of the internal combustion engine 2 by taking in the lubricating oil from the oil pan 8 through an oil strainer 14, increasing the pressure of the lubricating oil, and delivering the pressurized lubricating oil to the inlet of an oil filter 16.

The trochoidal pump 12 has, as shown by FIGS. 2 and 3, an inner rotor 18 having internal teeth 18*a* and an outer rotor 20 having external teeth 20*a*. The rotors are defined by a trochoid, and are eccentrically contained within a bore or pocket of a housing section 24 of a pump housing 22, namely with their respective centers being out of alignment. A pump gasket 28 cooperates with the housing.

With this first embodiment, FIG. 3 illustrates that the teeth 18*a* of said inner rotor 18 are five in number and the external teeth 20*a* of said outer rotor 20 are six in number. The inner rotor 18 is coaxially secured to the crank shaft 10. The pump housing 22 is also provided with a relief valve 30.

In this first embodiment, in order to prevent contact between the tip end 18*b* of the internal tooth 18*a* and the tip end 20*b* of the external tooth due to vibration of the outer rotor, the first distance T1 between the tip end 18*b* of the internal tooth 18*a* and the tip end 20*b* of the external tooth 20*a* is greater than zero when the tip end 18*b* of the internal rotor tooth 18*a* and the tip end 20*b* of the external rotor tooth 20*a* are positioned directly opposite each other due to the rotation of the outer rotor 20 in association of the inner rotor 18. Also, the arrangement of the center i of the inner rotor 18, the center O of the outer rotor 20 and the center P of the bore in the housing section 24 are set in such a manner that the maximum distance Tmax between the tip end 18*b* of the internal tooth 18*a* and the tip end 20*b* of the external tooth 20*a* is greater than the distance B between the outer periphery 20*c* of the outer rotor 20 and the inner periphery 24*c* of the housing section 24, namely Tmax>B, when the tip end 18*b* of the internal tooth 18*a* and the tip end 20*b* of the external tooth 20*a* are positioned directly opposite each other as shown in the upper portion of FIG. 3. The maximum distance Tmax between the tip ends is the result obtained by the addition of the first distance T1 between the tip end 18*b* of the internal tooth 18*a* and the tip end 20*b* of the external tooth 20*a* as shown in the upper portion of FIG. 3 and a second distance T2 between the tip end 20*b* of the external tooth 20*a* and a bottom 18*d* of a valley formed between the adjacent internal teeth 18*a* as shown in the lower portion of FIG. 3. Note that these distances T1 and T2 are the clearances located on diametrically opposite sides of the cooperating rotors.

Pumping action results from such construction in that when the inner and outer rotors 18 and 20 rotate together, oil is introduced from an inlet port 34 defined in a pump plate 28 into a space 32 formed between the internal tooth 18*a* and the external tooth 20*b* and, while expanding and contracting, in the direction of rotation of the inner and outer rotors 18 and 20, the oil is compressed by the decrease in volume of the space 32, and discharged from a discharge port 36 defined in the pump plate 28.

Next, the operation of the first embodiment will be described.

As the inner rotor 18 of the trochoidal pump 12 is driven by the crank shaft 10 in rotary motion, the internal tooth 18*a* of this inner rotor 18 enters into the valley between the adjacent external teeth 20*a* of the outer rotor 20, causing the space 32 to change its volume, while similarly the outer rotor 20 rotates in the same direction as the inner rotor 18, thus resulting in another change of the volume of the space 32, whereby the lubricating oil under low pressure as supplied from the inlet port 34 will be discharged under high pressure into the discharge port 36.

At this time, since with the tip ends 18*b* of the internal teeth 18*a* and the tip ends 20*b* of the external teeth 20*a* being opposed to each other in the vertical direction in FIG. 3, the maximum distance Tmax (Tmax=T1+T2) between the tip end 18*b* of the internal tooth 18*a* and the tip end 20*b* of the external tooth 20*a* has been set so as to be larger than the maximum distance B between the outer periphery 20*c* of the outer rotor 20 and the inner periphery 24*c* of the housing section 24, when the tip end 18*b* of the internal tooth 18*a* of the inner rotor 18 comes closer to the tip end 20*b* of the external tooth 20*a* of the outer rotor 20 under the influence of the outer rotor 20 which rotates in association with the inner rotor 18, it may be ensured that the actual first distance T1 between the tip end 18*b* of the internal tooth 18*a* and the tip end 20*b* of the external tooth 20*a* will be greater than zero.

As a result, independent from the rotation of the outer rotor, any interference by the internal and external teeth 18*a* and 20*a* can be avoided, and the internal and external teeth 18*a* and 20*a* may be in a regular intermeshing engagement, so that occurrence of pump noise can be minimized (that is, noise of the order of 3 dB can be reduced to a low level).

The first embodiment makes it possible to construct a trochoidal pump in which the values of control of the tolerances of inner and outer rotors 18, 20 may be clarified, the noise reduction may be improved and a stable performance can be secured.

Figure 4:
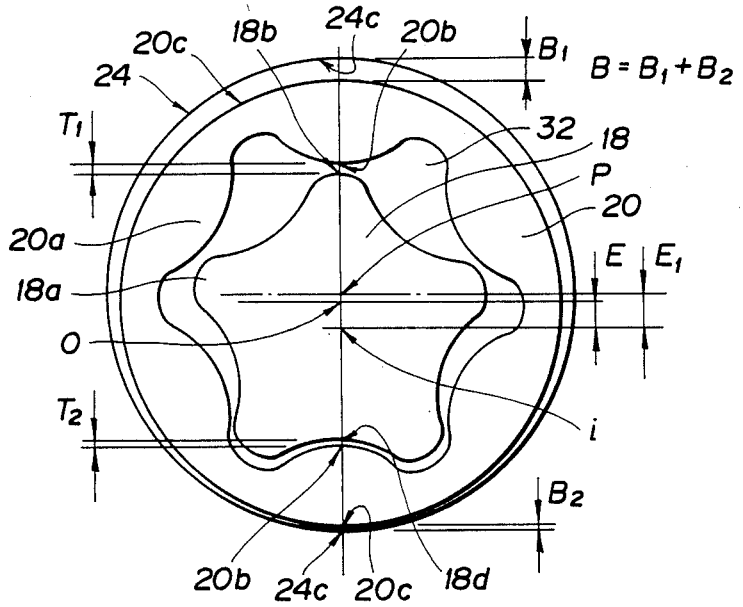
FIG. 4, showing a second embodiment of the present invention, is a schematic view of a trochoidal pump indicating the respective positional relation between the inner rotor, outer rotor and housing section.

FIG. 4 shows a second embodiment of the present invention wherein like reference notations are applied to designate corresponding parts performing the same functions as those in the first embodiment, as described above.

In the second embodiment, the center i of the inner rotor 18, the center 0 of the outer rotor 20 and the center P of the housing section 24 are so arranged as to satisfy the following relation:

$$E<E1<E+0.5(B+Tmax)$$

wherein, the maximum distance Tmax between the tip ends of the teeth and the aforementioned maximum distance B are in the relation of $Tmax \leqq B$, E is the distance between the center i of the inner rotor 18 and the center O of the outer rotor 20, E1 is the distance between the center i of the inner rotor 18 and the center P of the housing bore 24, and B is the maximum distance between the peripheries resulting from the addition of the first distance B1 between the outer periphery 20*c* of the outer rotor 20 and the inner periphery 24*c* of the housing section 24 as shown in the upper portion of FIG. 4 and the second distance B2 between the outer periphery 20*c* of the outer rotor 20 and the inner periphery 24*c* of the housing section 24 as shown in the lower portion of FIG. 4.

In accordance with the structure of the second embodiment, though conventionally there arose an interference when Tmax is smaller than clearance B (i.e. $Tmax<B$), by proper arrangement of the center i of the inner rotor 18, the center 0 of outer rotor 20 and the center P of the housing section 24 with respect to each other, the trochoidal interference can be prevented and pumping noise can be effectively decreased This is possible by adjusting the distance E by moving the outer rotor as in the third and fourth embodiments.

Figure 5:
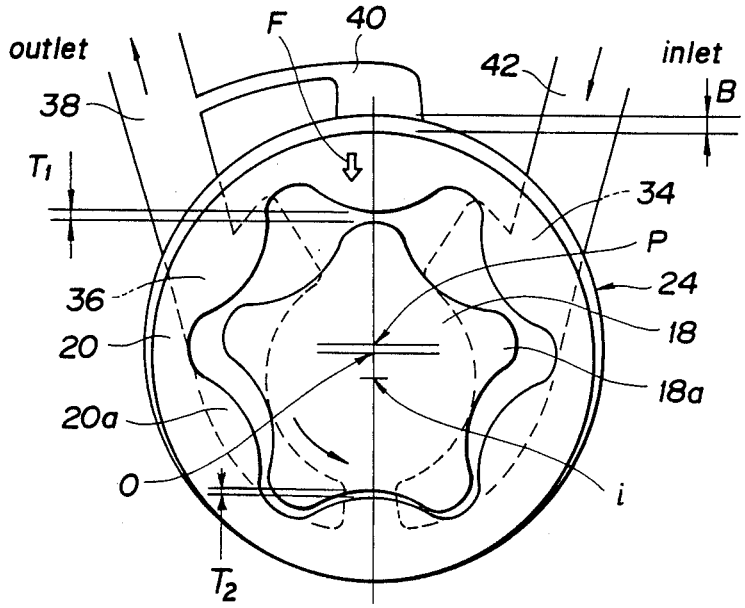
FIG. 5, showing a third embodiment of the present invention, is a schematic view of a trochoidal pump indicating the respective positional relation between the inner rotor, outer rotor and housing section.

FIG. 5 illustrates a third embodiment of the present invention.

This third embodiment is characterized in that with the maximum distance Tmax between tip ends being greater than the maximum distance B between the peripheries ($Tmax>B$), in order to ensure that when the tip end 18*b* of the internal tooth 18*a* of the inner rotor 18 and the tip end 20*b* of the external tooth 20*a* of the outer rotor 20 are positioned opposite each other by the rotation of the outer rotor 20 in association with that of the inner rotor 18, there is provided a first passage 40 connecting an outlet passage 38 with the housing bore 24 at the upper side of FIG. 5 so as to decrease the first distance T1 between the tip ends and that the discharge pressure from said first passage 40 is imposed on the exact area on the outer periphery 20C of the outer rotor 20 so as to move the outer rotor 20 by use of a pressure F. The numeral 42 designates an inlet passage.

In accordance with the structure of the third embodiment, the same effect as in the first embodiment can not only be obtained but also the first distance T1 between the tip ends can be secured in an easy and table manner even if there holds a relation of $Tmax>B$ and besides, the pumping efficiency may be increased by 20%.

In this third embodiment, in case the distance T1 between the tip ends is larger than the distance B between the peripheries, i.e., $T1>B$, the outer rotor is urgedly moved in the direction whereby the distance T1 between the tip ends becomes smaller.

Figure 6:
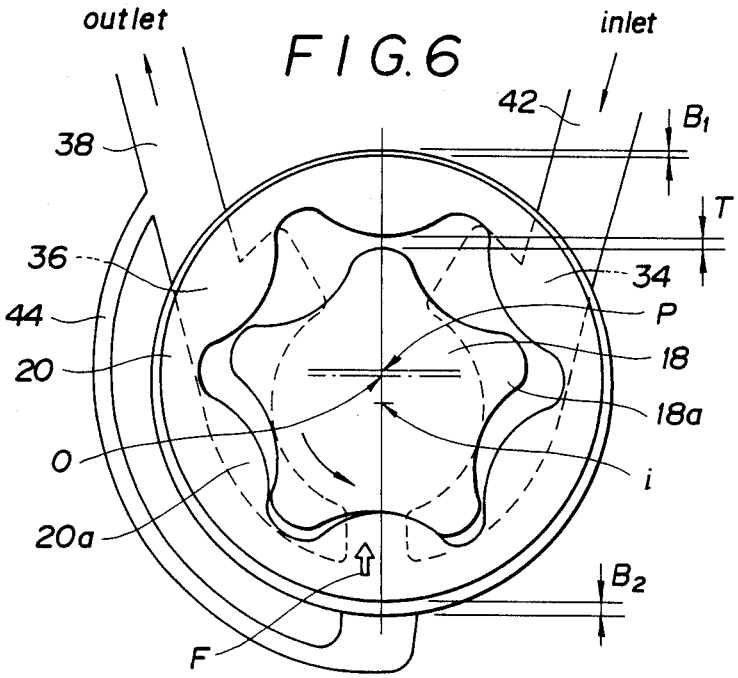
FIG. 6, showing a fourth embodiment of the present invention, is a schematic view of a trochoidal pump indicating the respective positional relation between the inner rotor, outer rotor and housing section.
Figure 7:
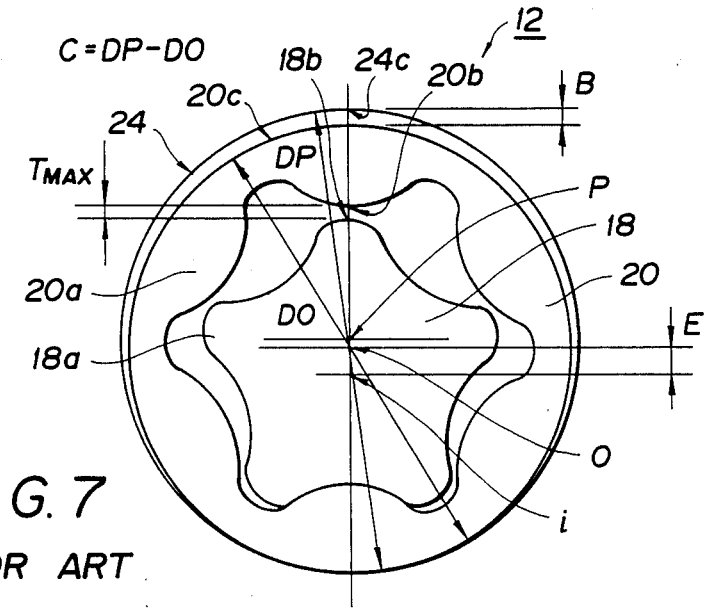
FIG. 7 PRIOR ART
FIGS. 7 and 8 are schematic views indicating the respective relation between the inner rotor, outer rotor and housing section in a conventional trochoidal pump.
Figure 8:
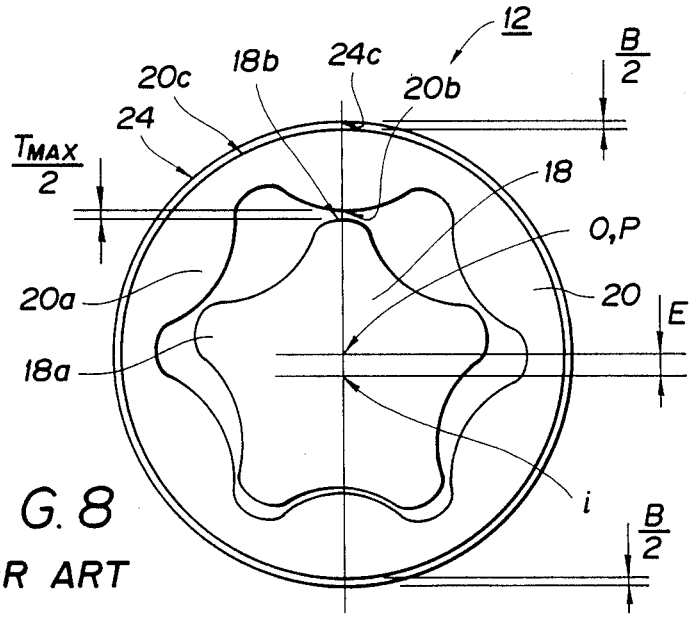
FIG. 8 PRIOR ART

FIG. 6 shows a fourth embodiment of the present invention.

This fourth embodiment is characterized in that with said maximum distance between tip ends being less than or equal to the maximum distance B between the peripheries, in order to ensure that when the tip end 18*b* of the internal tooth 18*a* of the inner rotor 18 and the tip end 20*b* of the external tooth 20*a* of the outer rotor 20 are positioned opposite each other by the rotation of the outer rotor 20 in association with that of the inner rotor 18, and that the first distance T1 between the tip end 18*b* of the internal tooth 18*a* and the tip end 20*b* of the external tooth 20*a* will be greater than zero, there is provided a second passage 44 connecting the outlet passage 38 with the interior of the housing bore 24 at the lower side of FIG. 6 so that a discharge pressure is imposed on the exact area on the outer periphery 20C of the external rotor 20 to force by a pressure F the outer rotor 20 in an upward direction so as to increase the distance T as shown in FIG. 6.

In accordance with the structure of this fourth embodiment, the same effect as in the first embodiment can not only be obtained but also the first distance T1 between tip ends may be secured in an easy and stable manner even if there holds a relation of $Tmax \leqq B$.

It goes without saying that the present invention is not restricted to the above embodiments and that various variations are possible.

For example, the position and interval relationships between the inner rotor, outer rotor and housing section were set in a geometrical manner in the first and second embodiments, and in a diametric manner in the third and fourth embodiments, but a combination of these embodiments may be used. Specifically, use of the combined first and third embodiments or the combined second and fourth embodiments will practically create no inconvenience in obtainment of the effect of the present invention.

It goes without saying that the trochoidal pump may not only be used as an oil pump for supplying lubricating oil to an internal combustion engine, but also as a hydraulic pump of an automatic transmission or a hydraulic device for other industrial machines.

As apparent from the above detailed description, in accordance with the present invention, by centering of the outer rotor to ensure that the distance between the tip ends of the inner and outer rotors will be greater than zero, independent from any fluctuation of the outer rotor, interference can be avoided by way of the internal teeth of the inner rotor and the external teeth of the outer rotor, and a regular intermeshing between the internal and external teeth can be achieved, thus resulting in decrease of occurrence of pump noise.

Furthermore, in accordance with the present invention, it is possible to construct a trochoidal pump in which clear values to control the tolerances of the rotors and other peripheral parts of the pump can be obtained, noise reduction has been improved, and its performance remains stable.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A trochoidal pump, comprising:

a pump housing having means defining a substantially circular bore therein, an annular outer rotor rotatably disposed in said bore and supported for radial movement therein, said annular outer rotor having a radially inwardly facing surface which defines a central opening therein substantially in the shape of a trochoid, said radially inwardly facing surface defining a plurality of radially inwardly projecting teeth which are spaced circumferentially uniformly around said central opening of said annular outer rotor, said inwardly facing surface having a plurality of radially inwardly opening concave recesses, each said recess being located circumferentially between a respective pair of said inwardly projecting teeth such that said teeth and said recesses are alternately circumferentially disposed, a disk-like inner rotor rotatably supported in said pump housing bore and positioned in said central opening of said outer rotor, said inner rotor being fixed against radial movement in said bore and having a radially outwardly facing peripheral surface which substantially defines a trochoid, said radially outward facing surface of said inner rotor defining a plurality of radially outwardly projecting teeth which cooperate with said radially inwardly opening recesses of said outer rotor, said radially outwardly projecting teeth being spaced circumferentially uniformly around the outer periphery of said inner rotor, said radially outwardly facing surface including a plurality of radially outwardly opening concave recesses which cooperate with said radially inwardly projecting teeth of said outer rotor, each said radially outwardly opening recess being located circumferentially between a respective pair of said radially outwardly projecting teeth such that said teeth and said recesses are alternately circumferentially disposed, said inner and outer rotors being arranged relative to each other and relative to said pump housing bore such that geometric centers of said rotors and said bore lie on a straight line, said outer rotor having an outer diameter which is less than an inner diameter of said pump housing bore such that a first radial clearance is defined in said bore radially outside of said outer rotor, said rotors being rotatably arranged in said bore such that one of said inwardly projecting teeth of said outer rotor periodically radially oppose one of said outwardly projecting teeth of said inner rotor along said straight line while another of said inwardly projecting teeth of said outer rotor is simultaneously radially received along said straight line in one of said recesses of said inner rotor, said one recess of said inner rotor being diametrically opposite said one tooth thereof, said inner rotor being dimensioned such that a second radial clearance is defined along said straight line between said inner and outer rotors when said teeth thereof are radially opposed along said straight line, said first radial clearance being larger than said second radial clearance, said outer rotor being radially movable along said straight line relative to said inner rotor and said pump housing for a distance equal to said second radial clearance such that an amount of radial separation between said opposed teeth of said inner and outer rotors along said straight line if variable; and adjustment means for increasing the amount of separation along said straight line between said opposed teeth by effecting movement of said outer rotor along said straight line.

2. A trochoidal pump, comprising:

a pump housing having means defining a substantially circular bore therein, an annular outer rotor rotatably disposed in said bore and supported for radial movement therein, said annular outer rotor having a radially inwardly facing surface which defines a central opening therein substantially in the shape of a trochoid, said radially inwardly facing surface defining a plurality of radially inwardly projecting teeth which are spaced circumferentially uniformly around said central opening of said annular outer rotor, said inwardly facing surface having a plurality of radially inwardly opening concave recesses, each said recess being located circumferentially between a respective pair of said inwardly projecting teeth such that said teeth and said recesses are alternately circumferentially disposed, a disk-like inner rotor rotatably supported in said pump housing bore and positioned in said central opening of said outer rotor, said inner rotor being fixed against radial movement in said bore and having a radially outwardly facing peripheral surface which substantially defines a trochoid, said radially outwardly facing surface of said inner rotor defining a plurality of radially outwardly projecting teeth which cooperate with said radially inwardly opening recesses of said outer rotor, said radially outwardly projecting teeth being spaced circumferentially uniformly around the outer periphery of said inner rotor, said radially outwardly facing surface including a plurality of radially outwardly opening concave recesses which cooperate with said radially inwardly projecting teeth of said outer rotor, each said radially outwardly opening recess being located circumferentially between a respective pair of said radially outwardly projecting teeth such that said teeth and said recesses are alternately circumferentially disposed, said inner and outer rotors being arranged relative to each other and relative to said pump housing bore such that geometric centers of said rotors and said bore lie on a straight line, said outer rotor having an outer diameter which is less than an inner diameter of said pump housing bore such that a first radial clearance is defined in said bore radially outside of said outer rotor, said rotors being rotatably arranged in said bore such that one of said inwardly projecting teeth of said outer rotor periodically radially opposes one of said outwardly projecting teeth of said inner rotor along said straight line while another of said inwardly projecting teeth of said outer rotor is simultaneously radially received along said straight line in one of said recesses of said inner rotor, said one recess of said inner rotor being diametrically opposite said one tooth thereof, said inner rotor being dimensioned such that a second radial clearance is defined along said straight line between said inner and outer rotors when said teeth thereof are radially opposed along said straight line, said second radial clearance being at least as large as said first radial clearance, said outer rotor being radially movable along said straight line relative to said inner rotor and said pump housing for a distance equal to said first radial clearance such that an amount of radial separation between said opposed teeth of said inner and outer rotors along said straight line is variable; and adjustment means for decreasing the amount of separation along said straight line between said opposed teeth by effecting movement of said outer rotor along said straight line.

3. The trochoidal pump according to claim 2, wherein first clearance is larger than said second clearance, and wherein said adjustment means includes a fluid inlet which communicates supplying pressurized fluid forcibly against the outside of said outer rotor, said fluid inlet being disposed in said pump housing and communicating with said bore at a location on said straight line which is diametrically opposite said opposed teeth of said inner and outer rotors.

4. The trochoidal pump according to claim 8, wherein said adjustment means includes a fluid inlet formed in said pump housing and opening into said bore along said straight line for supplying pressurized fluid forcibly against the outside of said outer rotor, said opposed teeth of said inner and outer rotors being disposed along said straight line between said fluid inlet and the geometric center of said pump housing bore.

5. In a trochoidal pump in which internal teeth of an inner rotor and external teeth of an outer rotor which are formed by trochoidal curves engage each other, said inner and outer rotors being provided in a pump housing enclosing portion, the center of the inner rotor, the center of the outer rotor, and the center of the enclosing portion being aligned on a straight line, and the center of the outer rotor being eccentrically positioned relative to the center of the inner rotor, said outer rotor being radially movably supported in said bore and said inner rotor being fixed against radial movement, the improvement wherein said rotors are arranged for rotation of the outer rotor in association with rotation of the inner rotor to produce an operating state in which a tip end portion of one internal tooth of the inner rotor and a tip end portion of one external tooth of the outer rotor face each other on one side of the straight line, a first distance between the mutually facing tip end portions of the internal and external teeth is set to a predetermined maximum separation distance, a bottom portion of said inner rotor between adjacent internal teeth thereof and a tip end portion of another external tooth of the outer rotor face each other on the other side of the straight line, a second distance between the bottom portion and the tip end portion of the associated external tooth is set to a predetermined minimum approach distance, and wherein a pressure communicating path is provided in the enclosing portion for allowing a pressure to act on the outer peripheral surface of the outer rotor on the straight line so as to maintain the predetermined relation between said first and second distances in such operating state.

6. A pump according to claim 5, wherein the sum of said first and second distances is greater than the maximum distance between the outer peripheral surface of the outer rotor and the inner peripheral surface of the enclosing portion, and wherein said pressure communicating path is provided in the enclosing portion on said one side of the straight line where the tip end portion of said one internal tooth of the inner rotor and the tip end portion of said one external tooth of the outer rotor face each other.

7. A pump according to claim 5, wherein the sum of said first and second distances is at most equal to the maximum distance between the outer peripheral surface of the outer rotor and the inner peripheral surface of the enclosing portion, and wherein said pressure communicating path is provided in the enclosing portion on the other side of the straight line where the bottom portion between the adjacent internal teeth of the inner rotor faces the tip end portion of the associated external tooth of the outer rotor.

* * * * *

UNITED STATES PATENT AND TRADEMARK OFFICE

CERTIFICATE OF CORRECTION

PATENT NO. : 4 976 595

DATED : December 11, 1990

INVENTOR(S) : Katuhico Taniguchi

It is certified that error appears in the above-identified patent and that said Letters Patent is hereby corrected as shown below:

In the Abstract, line 12; change "assocation" to ---association---.

Column 7, line 26; change "outward" to ---outwardly---.
line 51; change "oppose" to ---opposes---.

Column 8, line 1; change "if" to ---is---.

Column 9, line 10; change "claim 2," to ---claim 1,---.
lines 11 and 12; delete "first clearance is larger than said second clearance, and wherein".
line 13; after "communicates" insert ---with said bore and is directed along said straight line for---.
line 19; change "claim 8," to ---claim 2,---.

Signed and Sealed this

Tenth Day of November, 1992

*Attest:*

DOUGLAS B. COMER

*Attesting Officer*

*Acting Commissioner of Patents and Trademarks*